US008453997B2

(12) United States Patent
Fisenko

(10) Patent No.: US 8,453,997 B2
(45) Date of Patent: Jun. 4, 2013

(54) SUPERSONIC NOZZLE

(75) Inventor: Vladimir Vladimirovich Fisenko, St. Petersburg (RU)

(73) Assignee: Fisonic Holding Limited, Limassol (CY)

( * ) Notice: Subject to any disclaimer, the term of this patent is extended or adjusted under 35 U.S.C. 154(b) by 0 days.

(21) Appl. No.: 13/336,965

(22) Filed: Dec. 23, 2011

(65) Prior Publication Data

US 2012/0168526 A1 Jul. 5, 2012

Related U.S. Application Data

(63) Continuation-in-part of application No. 12/951,029, filed on Nov. 20, 2010, now Pat. No. 8,104,745, and a continuation-in-part of application No. 12/951,031, filed on Nov. 20, 2010.

(51) Int. Cl.
*B01F 3/04* (2006.01)

(52) U.S. Cl.
USPC ..... 261/21; 261/76

(58) Field of Classification Search
USPC ..... 261/21, 76, 78.2, 115, DIG. 65
See application file for complete search history.

(56) References Cited

U.S. PATENT DOCUMENTS

| | | | | |
|---|---|---|---|---|
| 3,143,401 | A * | 8/1964 | Lambrecht | 48/180.1 |
| 3,782,116 | A * | 1/1974 | Burge et al. | 60/258 |
| 4,460,519 | A * | 7/1984 | Leggett | 261/76 |
| 6,935,096 | B2 * | 8/2005 | Haiun | 60/39.5 |
| 8,104,745 | B1 * | 1/2012 | Fisenko | 261/21 |
| 2009/0121365 | A1 * | 5/2009 | Jacobs et al. | 261/76 |
| 2012/0125954 | A1 * | 5/2012 | Fisenko | 222/566 |
| 2012/0145050 | A1 * | 6/2012 | Fisenko | 110/219 |

FOREIGN PATENT DOCUMENTS

| | | | |
|---|---|---|---|
| RU | 2420674 | C2 * | 3/2010 |
| RU | 2008138162 | A * | 3/2010 |

* cited by examiner

*Primary Examiner* — Charles Bushey
(74) *Attorney, Agent, or Firm* — Novak Druce Connolly Bove + Quigg LLP; Jonathan Jaech

(57) ABSTRACT

A method of conversion of a single-phase stream into a supersonic homogenous two phase medium includes flowing the stream into an inlet section of a nozzle at an initial pressure, boiling a portion of the liquid medium by accelerating a velocity of the stream through a multistage draw-down of an inner diameter of the inlet of the nozzle to form a mixture of liquid and boiled fluid; and accelerating the mixture to a second velocity by flowing the mixture through an outlet section that diverges along the flow direction. The outlet section includes a concave portion, a convex portion, and a transition between the concave portion and the convex portion in which the concave profile smoothly transitions to the convex profile. A velocity of the stream is equal to a velocity of sound in the stream at a critical section located in the outlet section.

12 Claims, 2 Drawing Sheets

FIG. 1
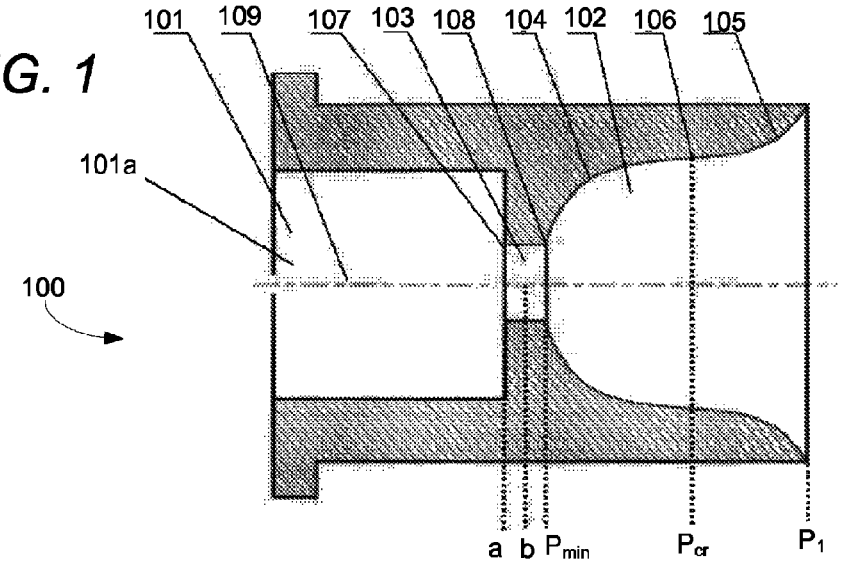
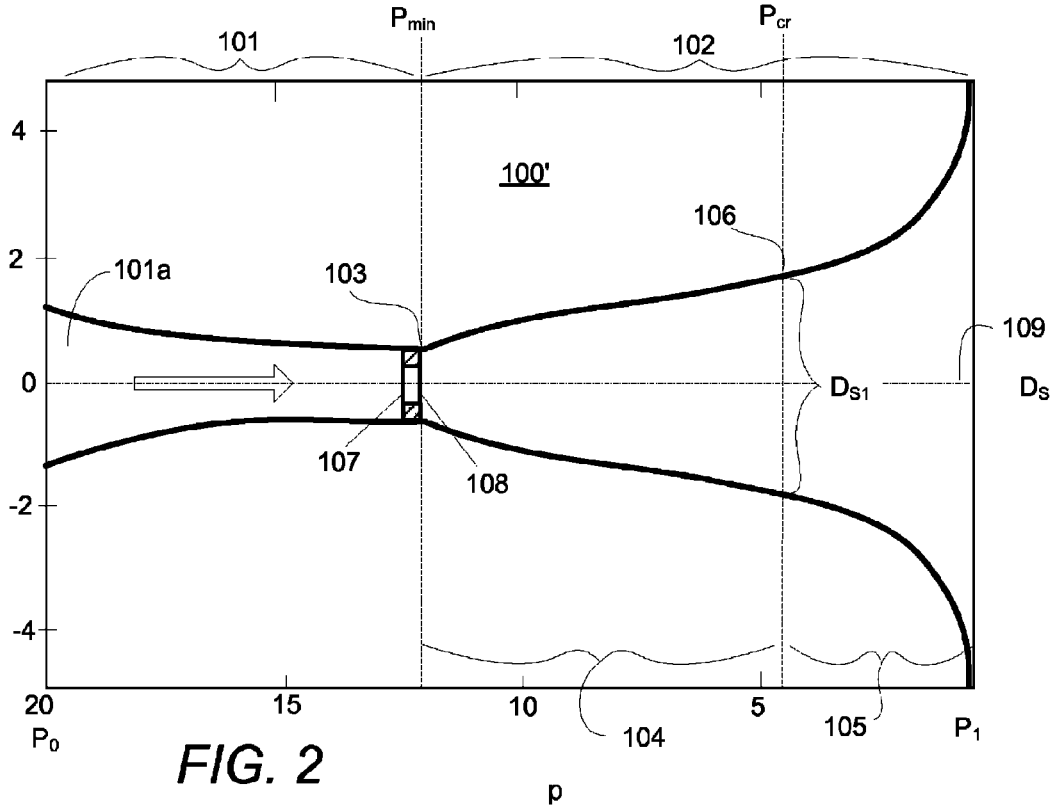
FIG. 2

SUPERSONIC NOZZLE

CROSS REFERENCE TO RELATED APPLICATIONS

This application is a continuation-in-part of application Ser. No. 12/951,029, now U.S. Pat. No. 8,104,475, and Ser. No. 12/951,031, both filed Nov. 20, 2010, which applications are hereby incorporated by reference in their entirety.

FIELD

This disclosure relates to fluidics, and the nozzle described can be used in a 5 jet apparatus for conversion of a liquid medium stream into a homogenous two-phase gas-liquid stream.

The nozzle can be used in heat power engineering for obtaining and conversion of heat energy in a supersonic stream of isotropic (homogenous) heterogeneous medium into kinetic energy.

The nozzle can also be applied in different industries where there is an interest in creating a homogenized two-phase medium in which the degree of dispersion of liquid particles (drops) is smaller than the length of their free run. This includes industries in which it is necessary to have a high degree of homogenization, for example in the food industry—for homogenization, preparation and their pasteurization of milk, juices, or for sterilization of food products; in the chemical industry—for creation of chemical reactors; and in the agriculture, medicine, pharmacology, etc., industries.

BACKGROUND

A de Laval nozzle for creation of a supersonic flow by passing a working medium through a converging-diverging channel under action of longitudinal pressure drop between the channel inlet and outlet is known; for example solid-propellant rocket engines. A de Laval nozzle is characterized by inlet and outlet sections that are respectively converging and diverging in the direction of the medium flow, between which a minimal cross-section is located.

However, the de Laval nozzle does not allow an efficient conversion of pressure energy into kinetic energy of the media stream, particularly in the event that a liquid is fed to the inlet of the supersonic nozzle and a two-phase medium is formed during its boiling due to the pressure drop inside of the nozzle below the saturation pressure.

A supersonic nozzle for boiling liquid is described in RU 2420674. This nozzles incorporates an inlet converging and an outlet diverging along the media flow sections. The minimum section of the nozzle is located between the inlet and the outlet, and the initial part of the diverging section of the nozzle has the shape of a concave curve towards the axis of the nozzle, and in the section of the nozzle where the flow velocity is equal to the local sound velocity, the curve smoothly changes to the convex curve towards the axis of the nozzle.

SUMMARY

Although the nozzle described in RU 2420674 allows conversion of a liquid stream into two-phase vapor-liquid stream, pressure energy and heat energy of the boiling liquid are not efficiently converted into kinetic energy due to possibility of stream separation of the walls of the diverging section of the nozzle. The stream separation leads to an increase in hydraulic losses in the flow part of the nozzle.

A target of the nozzle of the present disclosure is to decrease hydraulic losses in the course of conversion of a liquid stream into a gas-liquid stream.

A technical result of the nozzle of the present disclosure is an increase of efficiency of conversion of liquid internal energy into kinetic energy of a supersonic homogenous two-phase stream of medium.

In one aspect, a nozzle for conversion of a single-phase stream of a liquid medium into a supersonic homogenous two-phase gas and liquid medium includes an inlet section and an outlet section. The inlet section converges along a flow direction for the nozzle, and the inlet section has an inner diameter and a multistage draw-down of the inner diameter configured to boil a portion of the stream of the liquid medium. The outlet section diverges along the flow direction for the nozzle, the outlet section is coupled to the inlet section of the nozzle, the outlet section includes a concave portion, a convex portion, and a transition between the concave portion and the convex portion in which the concave profile smoothly transitions to the convex profile. The inlet section and outlet section are configured such that a critical section of the nozzle in which a velocity of the stream is equal to a velocity of sound in the stream is located in the outlet section.

Implementations may include one or more of the following features. The inlet section may be configured to change the stream of the liquid medium into a two-phase medium including gas microbubbles. The outlet section may be configured to further adiabatically boil the stream. The outlet section may be configured such that a boiling liquid medium of the stream moves through the outlet section without separating from the nozzle walls. The concave portion of the outlet section may be configured to provide acceleration of the boiling liquid medium stream to the sound velocity, and the convex portion of the outlet section may be configured to provide acceleration of the stream to a supersonic velocity.

Implementations may include one or more of the following features. The inlet section and outlet section may be configured such the transition is in the critical section. In the transition of the outlet section, a second-order derivative of the cross-sectional area taken along the flow direction may be equal to zero. The concave portion and the convex portion may have smoothly changing profiles. The inlet section may have a cylindrical section immediately before the outlet section. A ratio of a length of the cylindrical section to its diameter may be 0.5 to 1. The profile of the inlet section may be characterized by presence of a sharp edge located at the inlet to the cylindrical section along the stream flow. The concave portion of the outlet section may have a profile characterized by sudden enlargement of its diameter immediately adjacent the inlet. A first-order derivative of the cross-sectional area of the outlet section taken along the axis may have a maximum value immediately adjacent the inlet. A flow rate through the nozzle may be adjustable. The cylindrical section may be configured with an adjustable cross-sectional area. A seat and a relocatable valve may be located at an entrance to the inlet section. A profile of the outlet section may be substantially identical to the form of the stream profile calculated according to a reversible adiabat equation linking the diameter of the nozzle with the thermodynamic parameters of the stream for input parameters of temperature and pressure and accounting for an adiabatic index $k_p$ for the homogenous two-phase mixture. The adiabatic index $k_p$ characterizes vapor-water mist-like media, the sizes of particles of which may be smaller than the length of their free run. The adiabatic index $k_p$ may be determined by the relationship $$k_p = 0.592 + \frac{0.7088}{\beta_p},$$

where $0.5<\beta_p<1$ characterizes a volume ratio of liquid and gas phases in the stream of vapor-water media in the critical section.

In another aspect, a method of conversion of a single-phase stream of a liquid medium into a supersonic homogenous two-phase gas and liquid medium includes flowing the single phase stream into an inlet section of a nozzle along a flow direction at an initial pressure, the inlet section converging along the flow direction, boiling a portion of the liquid medium by accelerating a velocity of the stream through a multistage draw-down of an inner diameter of the inlet of the nozzle to form a mixture of liquid and boiled fluid; and accelerating the mixture to a second velocity by flowing the mixture through an outlet section that diverges along the flow direction. The outlet section includes a concave portion, a convex portion, and a transition between the concave portion and the convex portion in which the concave profile smoothly transitions to the convex profile. A velocity of the stream is equal to a velocity of sound in the stream at a critical section located in the outlet section.

Implementations may include one or more of the following features. The velocity of the stream is equal to the velocity of sound in the stream at the transition.

A good result is achieved in the case when the smooth transition of concave part of the nozzle's profile into the convex one (inflection point) is situated in the critical section where the second-order derivative of the section area along the nozzle axis is equal to zero or near the critical section. Besides the smooth transition of one part into another, the concave and convex parts also have smoothly changing profiles. The highest effectiveness of conversion of the inner energy of liquid into the kinetic energy of supersonic two-phase stream of medium is reached in the case when the profile of the concave part is executed close to the form of the stream's profile calculated according to equation of reversible adiabat linking the current diameter of the nozzle with the current thermodynamic parameters of the stream for the set input parameters of temperature and pressure and with account of the adiabatic index $k_p$ for the homogenous twophase mixture, namely, for a vapor-water mist-like (nano) medium, the sizes of particles of which are smaller than the length of their free run and interaction of these particles is elastic. At this the adiabatic index $k_p$ is determined by the relationship $$k_p = 0.592 + \frac{0.7088}{\beta_p},$$

where $0.5<\beta_p<1$ characterizes the volume ratio of gas phase in the flow of vapor-water media in the "critical" section of the nozzle.

Besides, in the applied solution the nozzle can be executed with possibility of varying of the area of the flow section for the liquid stream. For changing the area of the said section is can be supplied with a seat with a relocatable valve or a gate (diaphragm) executed with possibility of relocating. Changing of the area of the flow section can be realized by executing the details contacting with liquid medium of materials with high coefficient of temperature expansion, which expand or contract depending on the medium temperature. Such materials expand at increase of temperature of the flowing medium stream proving reduction of the flow section for this stream.

Besides, to use the nozzle as a heat generator the profile of the outlet section can additionally have a cylindrical part connected with the convex part; at this the cylindrical part is purposed for providing a pressure immediate change, in which conversion of kinetic energy of 30 the supersonic homogenous two-phase gas-liquid stream of medium into the heat energy occurs.

BRIEF DESCRIPTION OF THE DRAWINGS

The features, nature, and advantages of the present disclosure will become more apparent from the summary and detailed description considered in conjunction with the drawings described below. Throughout the drawings and detailed description, like reference characters may be used to identify like elements appearing in one or more of the drawings.

FIG. 1 is a diagram showing a cross-sectional view of a nozzle.

FIG. 2 is a diagram representing a cross-sectional view of a nozzle, according to an alternative embodiment including a spacer located in the narrow section of the nozzle.

DETAILED DESCRIPTION

Figure 3:
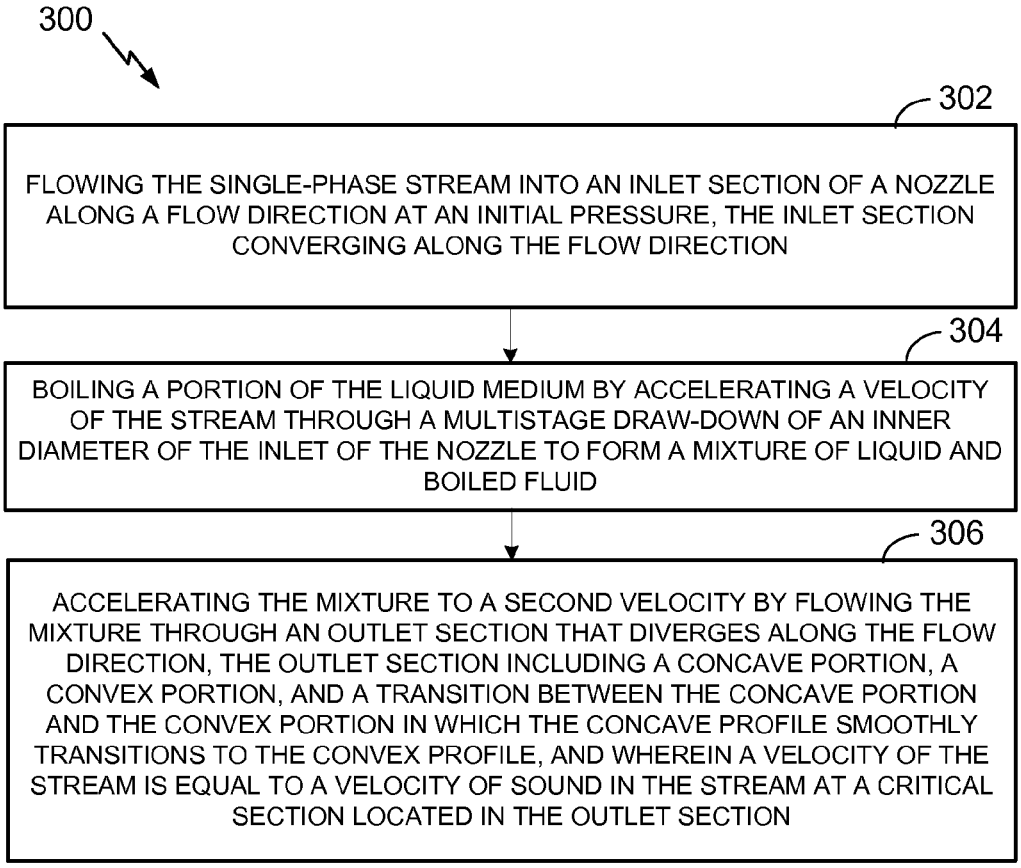
FIG. 3 is a flow chart summarizing aspects of operating a nozzle for boiling a liquid medium.

The nozzle is a supersonic nozzle for boiling liquid, e.g., water, is depicted in alternative embodiments in FIGS. 1-2. As used herein, "for boiling liquid" means that the liquid is introduced to the nozzle inlet at a pressure greater than the liquid's vapor pressure at the supplied liquid temperature, and pressure drop within the nozzle reduces the liquid pressure below its vapor pressure, causing boiling. Boiling liquid within the nozzle therefore does not require, nor does it preclude, the addition of heat to the liquid after introduction to the nozzle. The liquid may be heated to just below its boiling point prior to introduction to the nozzle.

In both FIGS. 1 and 2, a cylindrically symmetric nozzle body 100, 100' is depicted in a cross section taken through the nozzle's central cylindrical axis. Elements in figures are as follows:

101—inlet section,
102—outlet section,
103—part of the nozzle with minimum cross-section (cylindrical part),
104—convergent part,
105—divergent part,
106—inflection point,
107—sharp edge on the cylindrical part inlet,
108—edge on the cylindrical part outlet,
109—central axis of the nozzle.

Liquid enters the nozzle 100, 100' at the inlet 101 and is discharged from the outlet 102. Thus, the flow directions of the liquid in the depicted nozzle sections are from left to right.

A portion of the liquid passing through the nozzle is converted to a pressurized gas that exits the nozzle at supersonic speed. The nozzle includes an inlet section 101 and an outlet section 102. The inlet section includes a multistage draw-down of the inner diameter of the nozzle. The inlet section includes an upstream portion 101*a* and a throat portion 103 that is the narrowest portion of the nozzle (i.e., its throat). In some implementations the upstream portion 101*a* is of constant diameter along the direction of medium flow (see FIG. 1), whereas in other implementations the upstream portion 1*a* is convergent along the direction of medium flow (see FIG. 2).

The inlet section 101 is shaped such that, at an appropriate velocity of the liquid into the inlet of the nozzle, boiling of a part of the stream occurs to due to the shape of the inlet section with the multistage draw-down. In particular, boiling of the part of the stream can be enabled by forming a sharp edge 107, e.g., a right angle, at the interface "a" between the upstream portion 101*a* and the throat portion 103.

The throat portion 103 may have a channel of constant diameter "b" along the direction of medium flow. The throat portion 103 is the portion of the nozzle with the minimal cross-section perpendicular to the direction of medium flow. The throat portion 103 may be implemented using a spacer in the form of a cylindrical ring (see FIG. 2); the spacer may located in the place of transition from the inlet section to the outlet. In some implementations, the throat portion can have an adjustable cross-section, which permits changing of the flow section of the nozzle. For example, the throat portion 103 can also be realized by a valve with a seat located in the inlet to the nozzle, or by other mechanisms.

The outlet section 102 is divergent along the direction of medium flow. The geometric profile of the divergent outlet section 102 of the nozzle includes a concave part 104 adjacent the inlet section 101, e.g., adjacent the throat portion 103 with the minimal cross-section, and a convex part 105 that is farther from inlet section than the concave part 104 (concave and convex are relative to the axis of the nozzle 109). The concave part 104 of the profile transitions smoothly into the convex ex part 105. The transition 106 between the concave part 104 and the convex part 105 can be called a "flex point" or "inflection point".

The outlet section 102 may be shaped such that, at an appropriate velocity of the liquid into the inlet of the nozzle, a "critical section", i.e., at a position in the nozzle where the stream velocity is equal to the sound velocity, is located in the outlet section 102 (rather than in throat 103). In particular, for a given fluid, the combination of inlet pressure and nozzle shape can be selected such that the critical section occurs at the transition 6 between the concave part 104 and the convex part 105 of the outlet section 102.

Favorable efficiency can be achieved where the smooth transition of the concave part into the convex part (flex point 106) is located in the critical section of the nozzle (or near it) in which the stream velocity is equal to the local sound velocity, and where the second-order derivative of the cross-sectional area of the transition section 6 along the nozzle length is equal to zero.

The nozzle having the profile described above and under appropriate operating conditions unlike the Laval nozzle—is characterized by the following:

- the nozzle is subsonic not only in its converging inlet section 101, but also in some part of the diverging outlet section 102;
- a maximal specific flow rate of the medium is established in the narrowest portion 103 of the nozzle but in this portion the flow velocity is not equal to the local sound velocity (and in this meaning the section is not the "critical" section of the nozzle);
- the "critical" section, where the flow velocity is equal to the local sound velocity, is shifted downstream in the nozzle and is in the diverging outlet section 102 of the nozzle;
- in the "critical" section of the nozzle the second-order derivative of the sectional area along the nozzle length is equal to zero, whereas the first-order derivative of the sectional area along the nozzle length is non-zero. Thus, the relation of the area of the nozzle in the "critical" section to its length has not the minimum, as it is the case for the Laval nozzle but the flex of this relation.

In other words (which may be mathematically clearer), the second-order derivative of the cross-sectional area of the diverging outlet section 102 of the nozzle along the length of the nozzle has a negative value upstream of the transition 106; has a second-order derivative equal to zero in the transition 106 (which can be located where the flow velocity is equal to the local sound velocity), and has a positive value downstream of the transition 106.

The profile of the outlet section 102 is close to a profile calculated according to an equation of a reversible adiabatic expansion linking the current diameter of the nozzle with the thermodynamic parameters of the stream passing through the nozzle for the set input parameters of temperature and pressure of the medium stream and taking into account the adiabatic index $k_p$ for the homogenous two-phase mixture, namely, for a vapor-water mist-like (nanometer-scale particles) medium, the sizes of particles of which are smaller than the length of their free run and interaction of these particles is elastic.

The current parameters of the stream along the nozzle can be linked to the parameters of liquid on the inlet to the nozzle using the equation of the reversible adiabatic expansion and, therefore, the profile of the nozzle can be obtained in the form of the profile of the boiling stream at its non-separated flow in the nozzle's profile. For gas-liquid streams there is a possibility of reduction of resistance of a stream friction on the inner surface of the nozzle when the medium flows in transonic streams. The maximum specific discharge of medium is established in the narrowest part of a nozzle. Further downstream the specific mass discharge decreases, that is the weight stream is decelerated but local velocity of the stream in any section of the nozzle increases because of liquid evaporation at reduction of pressure, increase of a volume ratio of a gas phase, and reduction of the mixture density. At this the sound velocity decreases to achievement of a volume ratio of the gas phase the value equal to 0.5, then the sound velocity starts to grow.

In the nozzle section 106 in which the velocity of a stream becomes equal to the local sound velocity, i.e. in "critical" section of a nozzle (coinciding with a flex point of the generating line), the hydraulic resistance of a nozzle can be reduced, e.g., minimized, due to the effects of reduction of friction from the nozzle wall in the concave part 104 towards the axis of the nozzle. The effects of reduction of friction are connected with a pre-separated state of the boundary layer and suppression of turbulence in transonic gas-liquid streams. However this requirement is not obligatory. If the stream velocity does not reach the local sound velocity in the section corresponding to a flex point of the generating line of the nozzle, then transition through a sound velocity will occur in another section of a divergent nozzle.

Conversion of a part of a heat of vapor formation into a work of expansion from a liquid phase to a steam phase is the process of conversion of heat of a liquid into mechanical work and, accordingly, into energy of pressure and kinetic energy of a gas-liquid stream. At this, the initial energy of pressure is increased in the course of liquid boiling on value of work of expansion to vapor state.

In the process of boiling the stream due to lowering the pressure, the heat of the liquid is partially converted into the heat of vapor formation. The heat of vapor formation can be divided into two parts: heat necessary for destruction of cohesive forces of molecules, i.e., necessary for increase of internal energy of substance, and heat that is converted into expansion work from a liquid phase to a steam phase against forces of external pressure.

An increase of efficiency of the applied device can be provided at the expense of conversion of energy of the pressure into kinetic energy; the energy of pressure is added in the process of adiabatic boiling of a liquid. Besides, the expansion work from the liquid phase to the steam phase will provide changing from subsonic velocity to supersonic velocity of a gas-liquid stream, even when the stream velocity is not equal to local sound velocity in the section corresponding to a flex point of the nozzle generating line. The condition for such changing is coincidence of the stream velocity to the local sound velocity in any section of the divergent part of the nozzle, i.e., a finding of "critical" section the divergent part of the nozzle.

Therefore, at any position of a flex point in the divergent part of the nozzle, i.e., at any ratio of the lengths of concave part 104 and convex part 105, the technical result of an the increase of efficiency of pressure energy conversion into kinetic energy of a mixture can be reached. Energy of pressure is understood as the full sum of initial energy of pressure and the additional energy of pressure generated in the process of adiabatic boiling of a liquid.

At any ratio of lengths of the mentioned parts of the nozzle there will be a concave "bell-shaped" part of the nozzle. In this bell-shaped part of the nozzle the specific discharge of gas-liquid mixtures will decrease, and therefore the time the mixture stays in the nozzle will increase to make the liquid evaporate. In this part of the nozzle there will be a lowered hydraulic resistance occurred due to suppression of turbulence and a pre-separated condition of the boundary layer and consequently the technical result can be reached.

The technical result is in a combination of features characterizing geometry of the inlet and outlet sections, including executing of a concave part in the divergent part of the nozzle. The concave part is purposed for liquid evaporating in non-separating stream, in which the specific discharge reduces down-stream, i.e., the mass stream of a substance is decelerated and the time of the substance presence in the nozzle increases to bring the process closer to the ideal.

The positive effect is reached by special geometrical influence on a stream, using an equation for a stream profile of a reversible adiabatic expansion connecting geometry (current diameter of a nozzle) with current thermodynamic parameters of a stream, such as Equation 1 herein. Owing to use of a nozzle of particular geometry, boiling of the liquid occurs in the inlet section and the process of adiabatic liquid boiling is continued in the outlet section. The change of the nozzle profile changes the velocity of the stream (it continuously grows from the inlet section to the outlet). The change of the stream velocity is connected with a change of pressure in the stream (it continuously falls from the inlet section to the outlet), and the lower the pressure, the larger the percentage of the liquid that turns to vapor. The liquid on the inlet to the nozzle is under heated to saturation temperature. At the expense of narrowing of the nozzle velocity of the stream increases, pressure in the stream falls, the specific discharge of the section increases. The pressure in the stream falls until pressure in the stream becomes equal to pressure of saturation at the set temperature, at which point the liquid boils, the stream density sharply decreases, velocity of the stream sharply increases, and velocity of the sound sharply falls (compressibility of the stream increases), the derivative of the area of section on length of the nozzle grows. So proceeds until the volume ratio of phases in a mix reaches the value equal 0.5, then velocity of the stream will continue growing, and the sound velocity will start growing as well, rate of increase of the derivative area of section from length of the nozzle is slowed down, and then as the gas share in the mixture grows, its compressibility comes closer to compressibility of gas.

Dependences shown below describe a prospective (calculated) liquid flow, on the basis of these assumptions (calculations) the current diameter of the nozzle characterizing geometry of the nozzle may be determined.

Depending on the current value of pressure $P_0$ in the section, the current diameter $D_s$ in each cross-section of the nozzle along the flow is $$D_s = 1.129 \cdot \sqrt{\frac{G_S}{\rho_p \cdot w_p}} \quad \text{(Eq. 1)}$$

where $G_s$—is set liquid discharge through the nozzle;

$\rho_p$—is the density of media in the current section of the nozzle;

$W_p$—is the velocity of media in the current section of the nozzle.

A diameter $D_{s1}$ (m) of the "critical" section 106 of the nozzle is $$D_{s1} = 1.129 \cdot \sqrt{\frac{G_S}{g_{cr}}} \quad \text{(Eq. 2)}$$

where $g_{cr}$—is the specific critical discharge of media (kg/(s·m2)), determined by the relationship $$g_{cr} = \rho_{cr} \cdot a_p,$$

where $\rho_{cr}$ is the density of media in the "critical" section of the nozzle, kg/m3;

$a_p$ is the critical velocity of flow (m/s), equal to the sound velocity determined by the relationship $$a_p = \sqrt{\left(\frac{k_p - P_p}{\rho_{cr}}\right)} \quad \text{(Eq. 3)}$$

where $k_p$—is the adiabatic index for the current section of the nozzle determined by the relationship $$k_p = 0.592 + \frac{0.7088}{\beta_p} \quad \text{(Eq. 4)}$$

where $0.5<\beta_p<1$ is the volume ratio of liquid and gas phases in the flow of vapor-water media in the "critical" section of the nozzle under condition of that the homogenous two-phase mixture moving in the nozzle is a mist-like media, the sizes of particles of which are smaller than the length of their free run and interaction of these particles is elastic.

Calculation of cross-section (diameter) of the nozzle can be accomplished realized upon algorithm of calculation of a nozzle at adiabatic stream flow. Therefore, the stream parameters in the "critical" section of the applied nozzle including critical pressure and density, are defined from the equation of a reversible adiabatic expansion on initial parameters on the inlet to the nozzle and the equation of an adiabatic index (isentropic state) of the homogeneous two-phase mediums.

With use of adiabatic index in ratio for adiabatic streams an optimum profile for gas-liquid mixture with the set input and output parameters is received.

Besides, the possibility of initiation of boiling of the stream realized in the nozzle in its inlet section assists in the applied solution. To prevent a backlog of the boiling process at the achievement of pressure of saturation of vapor, presence of centers of vapor generation in a liquid stream is necessary. When vapor acts as the hot heat-carrier there is no such a problem because vapor forcing generates a considerable quantity of microscopic bubbles in the liquid stream. The bubbles contain vapor with the temperature much more surpassing temperature of a vapor bearing them, and, therefore, these bubbles represent act as the centers of vapor generation. It is different when the hot liquid, for example water, acts as the heating medium. Use in the nozzle design of a smoothly converging inlet for a liquid in the inlet section with lack of the vapor generating centers leads to a delay of a liquid boiling even after considerable pressure decrease below pressure of saturation. It in turn leads to nozzle work in a mode distinct from calculated, and, hence, to decrease in its efficiency and operating efficiency of all device as a whole. For elimination of this lack it is offered to use on the inlet to the nozzle an aperture with a sharp inlet edge, or to reduce in steps the internal diameter of the nozzle along the medium stream flow, or to use a spacer located in the section of transition from the inlet section to the outlet section.

Method of Nozzle Operation

Referring to FIG. 3, in a method 300 for operating a nozzle as described herein, hot liquid stream with the set parameters of pressure and temperature is fed to the inlet section 101 of the nozzle (FIG. 1) in which it flows with constants in velocity and pressure before step change of the internal diameter, i.e., transition to the outlet part 102 through a cylindrical part 103. As a result of step narrowing in the inlet section of the nozzle, the velocity of the stream increases, and pressure of liquid in the stream falls. The falling of the pressure is strengthened by separation of the stream from a sharp edge 107 in section (a) of the cylindrical part 103. As a result, at achievement of pressure of saturation at the set temperature, boiling of the hot liquid stream occurs that leads to formation of two-phase vapor-water medium in narrow section (b). At this, the stream density decreases, velocity increases and acceleration of the hot vapor-liquid stream in the inlet section of the nozzle occurs. Then the vapor-liquid stream from the inlet section is fed to the outlet section of the nozzle. In a concave part 104 of the diverging outlet section 102 of the nozzle further increase of the vapor-liquid stream velocity occurs. The velocity reaches local sound velocity and the vapor-liquid stream is fed to a convex 105 part of the outlet section of the nozzle where further acceleration of the stream occurs.

In the beginning of the outlet part 104 of the nozzle 103 the stream represents a liquid with microscopic bubbles of vapor. The microscopic bubbles provide the vapor generating centers and provide volume boiling of liquid in process of pressure decrease in the two-phase stream. The outlet part 102 of the nozzle has a geometrical profile, in which the two-phase medium flows without separation of the stream from the nozzle walls. In process of pressure decrease in the two-phase vapor generating is continued, because of it the density of the mixture decreases, velocity of the stream grows, and the sound velocity decreases. In section (d) (in critical section of the nozzle) velocity of the stream becomes equal to the sound velocity, and the stream becomes critical. At this medium with microscopic bubbles of vapor is transformed into the mist-like medium which sizes of particles are smaller than length of their free run. Further its expansion occurs with supersonic velocity. In section (e) on the outlet from the divergent part of the nozzle velocity reaches maximum. Therefore, the stream with supersonic velocity arrives in the outlet from the nozzle. At this an intensive conversion of liquid internal energy into kinetic energy of the stream occurs. Kinetic energy of the stream can be converted into heat energy in pressure sudden change which is organized downstream the outlet section of the nozzle. For this purpose the applied nozzle can additionally be supplied with the cylindrical part connected to the convex part of the outlet section or with the cylindrical plug connected to the outlet section of the nozzle.

In variant of the nozzle executing with the seat and the valve there is foreseen a possibility of regulating of discharge of medium flowing through the nozzle, the said possibility can be realized by means of relocatable valve or other known method. At this, stream boiling in any case occurs in the cylindrical part.

Consistent with and in summary of the foregoing, in an aspect of the present technology, the method 300 may include, at 300, flowing the single-phase stream into an inlet section of a nozzle along a flow direction at an initial pressure, the inlet section converging along the flow direction. The method 300 may further include, at 302, boiling a portion of the liquid medium by accelerating a velocity of the stream through a multistage draw-down of an inner diameter of the inlet of the nozzle to form a mixture of liquid and boiled fluid. The method may further include, at 306, accelerating the mixture to a second velocity by flowing the mixture through an outlet section that diverges along the flow direction, the outlet section including a concave portion, a convex portion, and a transition between the concave portion and the convex portion in which the concave profile smoothly transitions to the convex profile, and wherein a velocity of the stream is equal to a velocity of sound in the stream at a critical section located in the outlet section.

In further aspects of the method 300, the velocity of the stream may be equal to the velocity of sound in the stream at the transition. The method may further include converting the single-phase stream of the liquid medium into a two-phase medium including gas micro-bubbles in an inlet section of the nozzle. The method may further include adiabatically boiling the medium in the outlet section by pressure drop, optionally without addition of heat to the stream in the nozzle. The method may further include flowing the boiling liquid medium through the nozzle so that it moves through the outlet section without separating from the nozzle walls. The method may further include accelerating the liquid medium stream through the concave portion of the outlet section is to its sound velocity (i.e., sonic velocity), and accelerating the liquid medium in the convex portion of the outlet section to a supersonic velocity. The method may further include flowing the liquid so that a transition from subsonic to supersonic velocity of the medium occurs in the critical section. The method may further include adjusting a flow rate of the medium through the nozzle.

Example

The nozzle was made and its working ability with achievement of the applied result was checked. The nozzle 100 was made in variant represented in FIG. 1 and with the geometrical dimensions shown in the table.

During experimental work possibility of increase of effectiveness of conversion of pressure energy into kinetic energy of the stream of mediums mixture with liquid boiling in the flow part of the nozzle in comparison with the de Laval nozzle was confirmed.

| Symbolic notation | Parameter, dimension | Size, mm |
|---|---|---|
| D1 | diameter on the nozzle inlet, mm | 100 |
| D2 | diameter of the narrow section of the nozzle (cylindrical channel) | 20 |
| D3 | diameter on the nozzle outlet | 159 |
| L | length of the nozzle | 170 |
| L1 | length of the inlet section to the cylindrical channel | 143.5 |
| L2 | length of the cylindrical channel | 10 |
| L3 | length of the nozzle in the outlet section | 16.5 |

The above supersonic nozzle can be used in power engineering, and transport, as well as in food, chemical, pharmaceutical, oil refining, and other industries, in which the current interest is to obtain a supersonic stream of a homogenous two-phase mixture from gas of a saturated or heated liquid both for efficient conversion of potential energy of the liquid into kinetic energy of the mixture and preparation of a homogenous mixture of different substances and obtaining of a homogenous mixture with a well-developed phase interface, in which any exchange processes and chemical reactions take place intensively.

The invention claimed is:

1. A nozzle for conversion of a single-phase stream of a liquid medium into a supersonic homogenous two-phase gas and liquid medium, comprising:

an inlet section that converges along a flow direction for the nozzle, the inlet section having an inner diameter and a multistage draw-down of the inner diameter comprising a cylindrical section and a sharp edge located at an inlet to the cylindrical section; and an outlet section that diverges along the flow direction for the nozzle, the outlet section coupled to the inlet section of the nozzle, the outlet section including a concave portion characterized by a concave profile, a convex portion characterized by a convex profile, and a transition between the concave portion and the convex portion in which the concave profile smoothly transitions to the convex profile, and wherein the cylindrical section is immediately upstream of the outlet section and the inlet section and outlet section are configured such that a critical section of the nozzle in which a velocity of the stream is equal to a velocity of sound in the stream is located in the outlet section.

2. The nozzle of claim 1 wherein the inlet section and outlet section are configured such that the transition is in the critical section.

3. The nozzle of claim 1 wherein in the transition of the outlet section a second-order derivative of the cross-sectional area taken along the flow direction is equal to zero.

4. The nozzle of claim 1 wherein the concave portion and convex portion have smoothly changing profiles.

5. The nozzle of claim 1 wherein a ratio of a length of the cylindrical section to a diameter of the cylindrical section is 0.5 to 1.

6. The nozzle of claim 1 wherein the concave portion of the outlet section has a profile characterized by sudden enlargement of its diameter immediately adjacent an inlet to the outlet section.

7. The nozzle of claim 6 wherein a first-order derivative of the cross-sectional area of the outlet section taken along the axis has a maximum value immediately adjacent the inlet to the outlet section.

8. The nozzle of claim 6 wherein the cylindrical section is configured with an adjustable cross-sectional area.

9. The nozzle of claim 8 comprising a seat and a relocatable valve located at an entrance to the inlet section.

10. The nozzle of claim 1 wherein a profile of the outlet section is substantially identical to the form of the stream profile calculated according to a reversible adiabatic equation linking the diameter of the nozzle in the outlet section with thermodynamic parameters of the stream for input parameters of temperature and pressure and an adiabatic index $k_p$ for the homogenous two-phase mixture in the outlet section.

11. The nozzle of claim 10 wherein the adiabatic index $k_p$ characterizes vapor-water mistlike media, the sizes of particles of which are smaller than the length of their free run.

12. The nozzle of claim 11 wherein the adiabatic index $k_p$ is determined by the relationship $$k_p = 0.592 + \frac{0.7088}{\beta_p},$$

where $0.5<\beta p<1$ characterizes a volume ratio of liquid and gas phases in the stream of vapor-water media in the critical section.

* * * * *